US008376420B2

(12) United States Patent
Peterlunger

(10) Patent No.: US 8,376,420 B2
(45) Date of Patent: Feb. 19, 2013

(54) MAGNETIC LOCKING DEVICE

(75) Inventor: Alexander Peterlunger, Lustenau (AT)

(73) Assignee: Julius Blum GmbH, Hochst (AT)

( * ) Notice: Subject to any disclaimer, the term of this patent is extended or adjusted under 35 U.S.C. 154(b) by 89 days.

(21) Appl. No.: 12/081,921

(22) Filed: Apr. 23, 2008

(65) Prior Publication Data

US 2008/0203738 A1 Aug. 28, 2008

Related U.S. Application Data

(63) Continuation of application No. PCT/AT2007/000116, filed on Mar. 8, 2007.

(30) Foreign Application Priority Data

Mar. 8, 2006 (AT) ..... A 384/2006

(51) Int. Cl.
*E05C 17/56* (2006.01)

(52) U.S. Cl. ..... 292/251.5; 292/DIG. 4

(58) Field of Classification Search ..... 292/251.5, 292/DIG. 4, 332, 333, 337, DIG. 37
See application file for complete search history.

(56) References Cited

U.S. PATENT DOCUMENTS

| | | | | |
|---|---|---|---|---|
| 3,492,037 | A | 1/1970 | Hutchinson | |
| 4,227,726 | A * | 10/1980 | Sorimachi | 292/251.5 |
| 4,249,761 | A * | 2/1981 | Nishimura | 292/251.5 |
| 5,758,913 | A * | 6/1998 | Roth et al. | 292/251.5 |
| 6,592,156 | B2 * | 7/2003 | Levine | 292/23 |
| 7,152,892 | B2 * | 12/2006 | Rechberg | 292/304 |
| 7,273,240 | B2 * | 9/2007 | Migli | 292/251.5 |
| 2005/0268432 | A1 * | 12/2005 | Migli | 16/258 |

FOREIGN PATENT DOCUMENTS

| | | |
|---|---|---|
| CN | 2748606 | 12/2005 |
| DE | 1 784 817 | 1/1972 |
| DE | 40 11 722 | 10/1990 |
| DE | 44 37 440 | 4/1996 |
| DE | 103 36 433 | 3/2005 |
| EP | 1 598 509 | 11/2005 |
| GB | 730956 | 6/1955 |
| GB | 795435 | 5/1958 |
| GB | 2 017 201 | 10/1979 |
| JP | 2000-248811 | 9/2000 |

OTHER PUBLICATIONS

International Search Report issued Oct. 24, 2007 in the International (PCT) Application of which the present application is the U.S. National Stage.
Austrian Search Report issued Dec. 14, 2006 in the corresponding Austrian patent application.

* cited by examiner

*Primary Examiner* — Carlos Lugo
*Assistant Examiner* — Mark Williams
(74) *Attorney, Agent, or Firm* — Wenderoth, Lind & Ponack, L.L.P.

(57) ABSTRACT

A closing and opening device for a furniture element is mounted movably on an item of furniture. The device includes a lockable ejection device for moving the movable furniture element out of a closed end position into an open position, and further includes a magnetic retaining device for the movably mounted furniture element. The magnetic retaining device includes at least two parts of which a first part is or can be arranged on the furniture body and the second part is or can be arranged on the movable furniture element and which exert a magnetic attraction force on each other at least in the closed position of the movable furniture element. The first part of the retaining device, that is arranged on the furniture body, is mounted movably in the direction of the movable furniture element and is acted upon by a force storage means acting in the closing direction of the movable furniture element.

23 Claims, 10 Drawing Sheets

MAGNETIC LOCKING DEVICE

This application is a continuation of International Application No. PCT/AT2007/000116, filed Mar. 8, 2007.

BACKGROUND OF THE INVENTION

The invention concerns a closing and opening device for a furniture element which is mounted movably on an item of furniture. The device includes a lockable ejection device for moving the movable furniture element out of a closed end position into an open position, and further includes a magnetic retaining device for the movably mounted furniture element. The magnetic retaining device comprises at least two parts of which a first part is or can be arranged on the furniture body, and the other part is or can be arranged on the movable furniture element and which exert a magnetic attraction force on each other at least in the closed position of the movable furniture element. The first part of the retaining device, that is arranged on the furniture body, is mounted movably in the direction of the movable furniture element.

The magnetic retaining devices for keeping a portion shut of the general kind set forth which are known from the state of the art can be subdivided into two groups depending on their respective kind of use. More specifically, those two groups include a first group of those whose function is restricted to holding the movable furniture element in the closed position, and a second group of those which are used in combination with an ejection device.

If the magnetic retaining device is used exclusively to arrest a movable portion of an article of furniture in a closed position, it is known for the first portion, arranged on the furniture carcass, of the magnetic retaining device to be subjected to the action of a spring in the direction of the movable furniture element, and for it to be arranged on the furniture carcass in such a way that that first portion of the magnetic retaining device projects a certain amount beyond the front of the furniture carcass when the furniture element is opened. That is intended to ensure that this generally magnetic portion of the magnetic retaining device, upon closure of the movable furniture element, comes into contact with the magnetizable counterpart pole, arranged on the movable furniture element, of the magnetic retaining device, even when the movable furniture element does not bear directly against the front of the furniture carcass. It has been found that this state of the art suffers from the disadvantage that a rebound movement of the movable furniture element which occurs when the movable furniture element is slammed shut by a user with excessive force is still further increased by the spring which acts in the opening direction of the movable furniture element and which acts on the portion, arranged on the furniture carcass, of the magnetic retaining device. This slamming can thereby result in the movable furniture element being torn off the movable portion of the magnetic retaining device, that is arranged on the furniture carcass.

The second group of known magnetic retaining devices is used in combination with lockable ejection devices which are based on the touch-latch principle. In such a magnetic retaining device described for example in EP 1 598 509 A1, movable mounting of the portion of the magnetic retaining device, that is arranged on the furniture carcass, is necessarily such that the generally magnetic first portion of the magnetic retaining device, starting from a closed end position of the movable furniture element in which the two portions of the magnetic retaining device bear against each other can be moved in the closing direction of the movable furniture element. Therefore, as is known per se, the locked ejection device is released, and thus the portion of the magnetic retaining device that is associated with the furniture carcass must also be moved into a position which—viewed in the closing direction of the movable furniture element—is behind the closed end position of the furniture element. It has been found that the state of the art suffers from the disadvantage that the first portion of the retaining device, that is arranged on the furniture carcass, does not have a defined neutral position when the movable furniture element is opened, whereby unwanted noise generation can occur by virtue of the movement of the first portion of the retaining device both upon closure and also upon opening of the movable furniture element (that is to say, when the contact between the two portions of the magnetic retaining device is made or released).

In addition, DE 40 11 722 A1 discloses a closing device for a movable portion of an article of furniture, in which the first portion of a magnetic retaining device that is associated with the furniture carcass has a two-part structure. A portion is mounted movably, and the mobility of the portion serves to cancel or enhance the magnetic action of that first portion, associated with the furniture carcass, of the magnetic retaining device, depending on the position of the two portions relative to each other.

SUMMARY OF THE INVENTION

Taking that state of the art as a basic starting point, the object of the invention is to improve a magnetic retaining device and a closing and opening device of the kind set forth in the opening part of this specification, avoiding the above-described disadvantages, and to provide overall a structurally simple solution which provides a low level of noise.

The invention attains that object in that the first part of the magnetic retaining device is acted upon by a force storage means (elastic element) acting in the closing direction of the movable furniture element.

The fact that the force storage means acting on the first part of the magnetic retaining device acts in the closing direction of the movable furniture element provides that a rebound movement of the movable furniture element as a consequence of the movable furniture element being excessively vigorously slammed shut by a user is damped by the force storage means acting in the closing direction of the movable furniture element. In other words, the force storage means (elastic element) acts like a brake. At the same time, the force storage means damps the movement of the first part of the retaining device, which in accordance with a further embodiment is mounted in a preferably cylindrical housing in such a way that it can issue through an opening thereof, whereby the generation of noise upon reaching an end position of that first part of the retaining device in the housing is reduced.

While therefore the state of the art provides that the rebound movement is increased by the spring acting in the opening direction, that rebound movement in the case of the retaining device according to the invention is reduced by the force storage means acting in the closing direction. In addition, the movable furniture element, after it has come to a stop as a result of the braking action of the force storage means, is pulled in the direction of the furniture body by the force storage means (elastic element) which is then being relieved, as far as the closed position of the movable furniture element, which corresponds to the defined end position of the first part of the magnetic retaining device.

In accordance with a further embodiment of the invention, a structurally simple solution is afforded if the force storage means is in the form of a pressure storage means and is arranged between an abutment provided in the region of the opening disposed internally at the housing and a flange-like enlargement at the first part of the retaining device.

Even if a preferred embodiment of the invention provides that the force storage means which acts in the closing direction of the movable furniture element is formed by a spring, in accordance with an alternative embodiment the force storage means can also be formed by an elastomer element. It would equally be conceivable for the force storage means to be formed by a fluid pressure storage means.

In accordance with a further preferred embodiment, it is provided that the force storage means (elastic element) acting in the closing direction of the movable furniture element is subjected to a traction loading and is preferably in the form of a tension spring.

Irrespective of the design configuration of the force storage means, a basic idea of the invention provides that the first part of a magnetic retaining device is mounted movably on the furniture body and is to be acted upon in the closing direction of a movable furniture element in order in that way to provide a rebound safeguard for the movable furniture element and to ensure that the movable furniture element is guided into a defined closed position by means of the magnetic retaining device. That provides a greatly simplified construction in comparison with the state of the art in which additional mechanisms such as for example pull-in devices or hinges with a closure mechanism are necessary for guiding the movable furniture element into its closed position.

A further embodiment provides that a per se known closing and opening device, in particular a touch latch mechanism, is combined with a magnetic retaining device according to the invention, in such a way that the lockable ejection device has an ejection element which is acted upon by a force storage means. The ejection element and the first part of the retaining device are arranged movably relative to each other in a housing with at least one exit opening, and in which respect in the sense of a solution which saves on space, it has proven to be advantageous if the ejection element and the first part of the retaining device are arranged coaxially in the preferably cylindrical housing.

In accordance with a preferred embodiment of the invention, it is provided in that respect that the ejection element is of a sleeve-shaped configuration and the first part of the retaining device is arranged in the interior of the sleeve-shaped ejection element, thereby providing that the second part of the magnetic retaining device that is arranged on the movable furniture element can be kept relatively small.

A particularly preferred embodiment of a closing and opening device according to the invention, with which a compact structure is achieved, provides a preferably tubular mounting element which is open on the face and in which a cylindrical housing is arranged. The cylindrical housing is adapted to receive a sleeve-shaped ejection element and a first part of a magnetic retaining device, which first part is mounted coaxially with the sleeve-shaped ejection element in the interior thereof. The ejection element at the external peripheral surface thereof has a control cam into which engages a control element arranged at the internal peripheral surface of the cylindrical housing. The ejection element and the first part of the magnetic retaining device are or can be respectively acted upon by at least one force storage means (elastic element) preferably formed by a spring, of which force storage means the force storage means for the ejection element acts in the opening direction and the force storage means for the first part of the retaining device acts in the closing direction of the movable furniture element.

An alternative embodiment provides that the lockable ejection device has an ejection element acted upon by a force storage means. The ejection element is of a multi-part structure and the force storage means which is preferably in the form of a tension spring acts between two portions of the ejection element.

A solution which achieves spaces saving can be attained in that respect if the two portions of the ejection element are preferably arranged movably relative to each other in a housing with at least one exit opening, in which respect it has proven to be desirable if the two portions of the ejection element are arranged in the housing movably in the longitudinal direction of the housing and/or rotatably about a longitudinal axis thereof.

In accordance with a further embodiment of the invention, a structurally simple and robust solution is achieved if the first part of the retaining device is arranged in the interior of a first preferably sleeve-shaped portion of the ejection element.

A compact structure of a closing and opening device which is combined with a retaining device and which in particular is in the form of touch-latch mechanism is achieved in accordance with a further embodiment of the invention if the first preferably sleeve-shaped portion of the ejection element and the first part of the retaining device are arranged coaxially in the preferably cylindrical housing. In that respect, whether the touch-latch mechanism follows the ballpoint pen principle or includes a control lever guided in a heart-shaped control cam does not play an essential part.

What is essential to the invention at any event is the fact that the second portion of the ejection element serves as a functional element of the locking and unlocking mechanism. An embodiment of the invention provides that a control cam for receiving a control element preferably stationarily connected to the housing is arranged or provided at the second portion of the ejection element. Alternatively, at least one control element for engagement into a control cam preferably stationarily connected to the housing is arranged or provided at the second portion of the ejection element.

A further essential feature of the invention provides that the first portion of the ejection element and the first part of the magnetic retaining device are or can be respectively acted upon by at least one force storage means (elastic element) preferably formed by a spring, of which the force storage means for the ejection element acts in the opening direction and the force storage means for the first portion of the retaining device acts in the closing direction of the movable furniture element.

A further embodiment of the invention concerns an item of furniture having a closing and opening device according to the invention.

A further embodiment of the invention provides that the first part of the retaining device and/or the second part of the retaining device is or are magnetic.

BRIEF DESCRIPTION OF THE DRAWINGS

Further details and advantages of the invention are described in greater detail in the specific description hereinafter with reference to the embodiments illustrated in the drawings in which.

DETAILED DESCRIPTION OF THE INVENTION

FIGS. 1*a* through 3*c* show a closing and opening device 13 for a furniture element 2, which is mounted movably on an item of furniture 3. The closing device 13 includes a lockable ejection device combined with a magnetic retaining device 1, for moving the movable furniture element 2 out of a closed end position E into an open position.

Figures 1A, 1B:
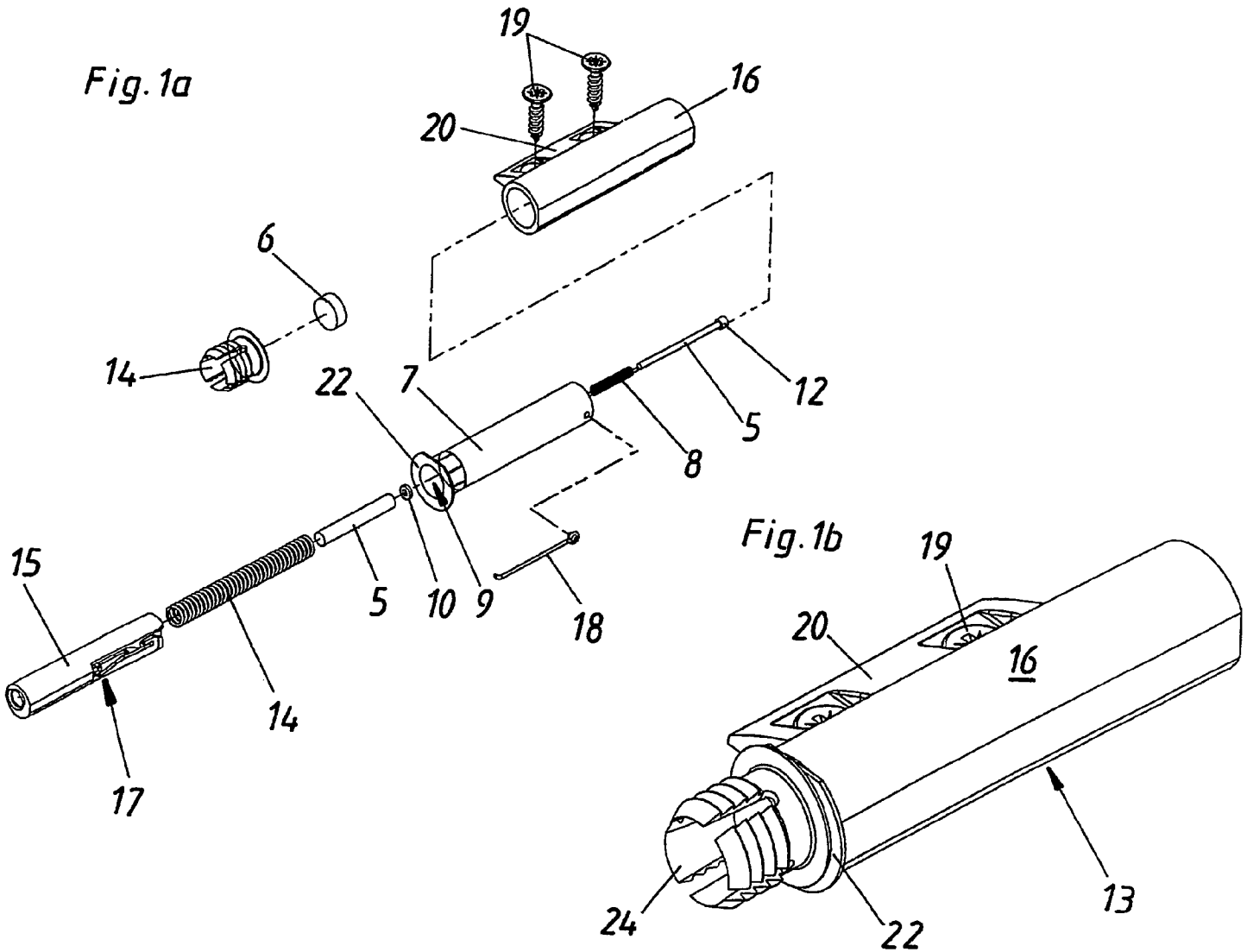
FIG. 1*a* shows an exploded view of a first embodiment of the invention.
FIG. 1*b* shows the assembled embodiment of FIG. 1*a*.

FIG. 1*a* shows an exploded view of the individual parts of the closing and opening device 13. Therein reference 15 denotes the ejection element which in the illustrated embodiment has a sleeve-shaped configuration, with a control cam 17 being provided externally at the peripheral surface thereof. The sleeve-shaped ejection element 15 is acted upon by a first force storage means (elastic element) 14 which in the illustrated embodiment is in the form of a compression spring and which is mounted in the interior of the sleeve-shaped ejection element 15. The first part 5, 5' of the magnetic retaining device 1 is arranged coaxially with the ejection element 15 and the first force storage means 14, and in such a way that it can pass through the first force storage means 14 and the ejection element 15.

In the illustrated embodiment, the first part 5, 5' of the magnetic retaining device 1 is has two-part configuration and includes a front part 5 which is magnetic and a rear part 5', wherein the front part 5 and the rear part 5' can be screwed together by means of a screwthreaded connection.

The housing 7 is adapted to receive both the first part 5, 5' of the magnetic retaining device 1 and also the lockable ejection device and has an opening 9 on the face through which both the ejection element 15 and also the front first part 5 of the magnetic retaining device 1 can extend in the direction of the movable furniture element 2. A control element 18 is arranged pivotably at the internal peripheral surface of the sleeve 7 in such a way that the free end, which is bent downwardly in a hook shape of the control element 18—when the ejection element 15 is fitted into the housing 7—engages into the control cam 17 provided at the external peripheral surface of the ejection element 15. In that way, in accordance with the known touch-latch mechanisms, the control element 18 arrests or releases the ejection element 15, depending on the respective position of the control element 18 in the control cam 17.

The rear first part 5' of the first portion of the magnetic retaining device 1 which carries the flange-like enlargement 12 serving as an abutment for a second force storage means (elastic element) 8 of the magnetic retaining device 1 is introduced into the housing 7 from the rearward side and screwed to the front first part 5 of the magnetic retaining device 1. In that case, as can be seen in particular from FIG. 2*e*, the second abutment 11 for the second force storage means (elastic element) 8 is provided in the interior of the housing 7.

The housing 7 therefore serves on the one hand for receiving the entire lockable ejection device as well as the first part 5, 5', associated with the furniture body 4, of the magnetic retaining device 1. In addition, provided for receiving the housing 7 which is cylindrical in the illustrated embodiment there is a mounting element 16 which is also cylindrical and carries a lateral axial flange 20 having through openings for allowing mounting of the mounting element 16 to the furniture body 4 by means of screws 19.

FIG. 1*a* also shows the second part 6 of the magnetic retaining device 1 which in the illustrated embodiment is magnetizable, for example in the form of an iron core, and which can be arranged by a mounting sleeve 24 on the movable furniture element 2.

FIGS. 2*a* through 2*f* show different positions of a first embodiment of an opening and closing device 13 according to the invention. In that respect, the movable furniture element 2 and the furniture body 4 are not shown for the sake of clarity of the drawing.

Figure 2A:
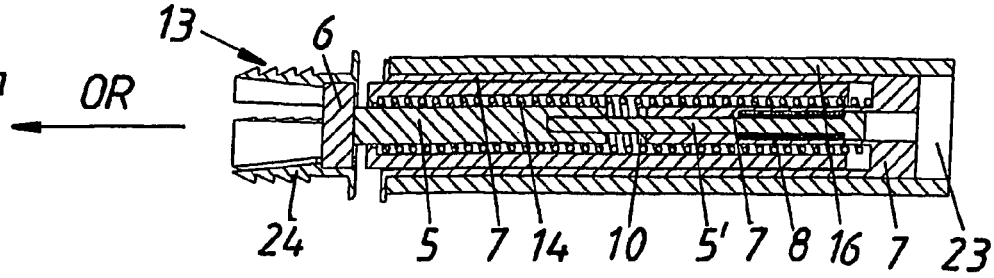
FIGS. 2*a*-2*f* show different positions of the embodiment of FIG. 1*a* during an opening/closing process.
Figure 2B:
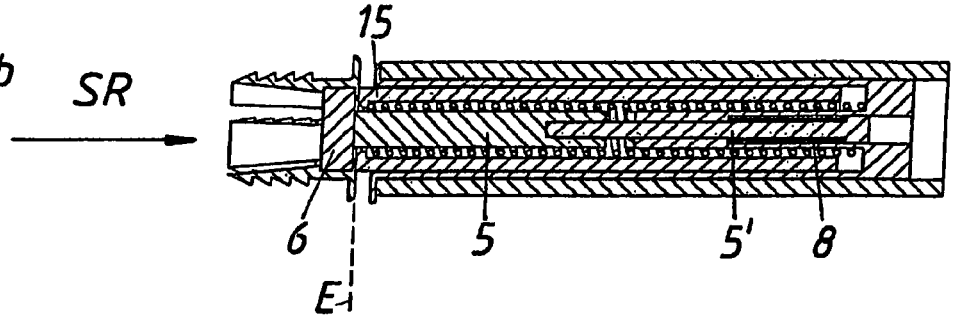
Figure 2C:
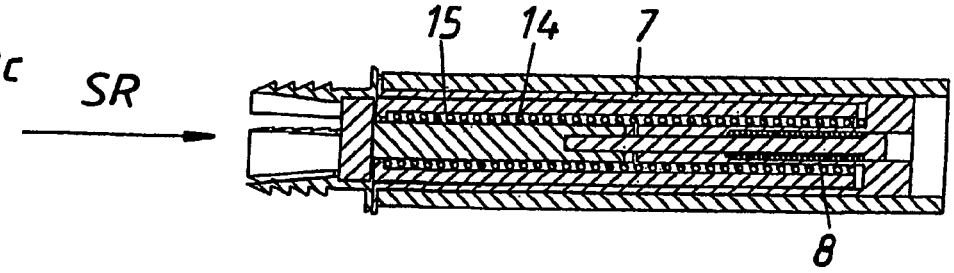

In FIG. 2*a*, the movable furniture element 2 and therewith the mounting sleeve 24 are just involved in a rebound movement in the opening direction OR of the movable furniture element 2. At that time, the ejection element 15 is already locked while the first part 5, 5' of the magnetic retaining device 1 is being moved out of the housing 7 by virtue of the magnetic attraction force between the second part 6 and the first part 5, 5' of the magnetic retaining device 1 against the action of the second force storage means (elastic element) 8 in the opening direction OR of the movable furniture element 2. In other words, the force storage means 8 is acting as a rebound brake.

After the movable furniture element 2 has come to a stop, the first part 5, 5' of the magnetic retaining device 1 is moved towards the furniture body by way of the second force storage means 8 which is being relieved (urging) in the closing direction SR of the movable furniture element 2 until the movable furniture element 2 has reached its closed end position E (FIG. 2).

At that moment, the movable furniture element 2 bears against the ejection element 15 which projects somewhat with respect to the front of the furniture body. The front gap remaining between the movable furniture element 2 and the furniture body 4 is necessary to be able to move the movable furniture element 2 in the closing direction SR into a release position which is behind the closed end position E and in which unlocking of the ejection device occurs. As can be seen from FIG. 2*c* the force storage means 8 of the magnetic retaining device 1 is unloaded in that release position of the movable furniture element 2.

Figure 2D:
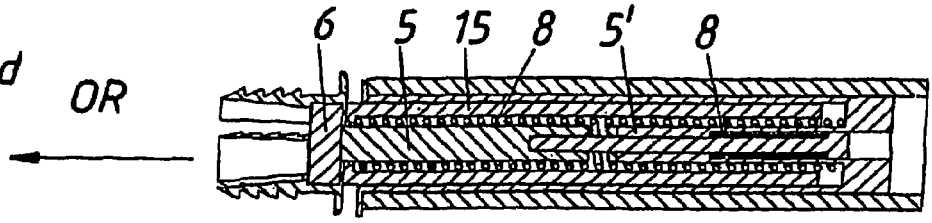

In FIG. 2*d* the user has already terminated the application of pressure to the movable furniture element 2 so that the movable furniture element 2 is moved in the opening direction OR into an open position by virtue of the unlocked ejection device by means of the ejection element 15 which is acted upon by the first force storage means 14 as it is relieved of load. In that case, firstly the first part 5, 5' of the magnetic retaining device 1 is also moved in the opening direction OR by virtue of the magnetic attraction force between the second part 6 and the first part 5, 5', more specifically until the second force storage means (elastic element) 8 is entirely loaded up.

Figure 2E:
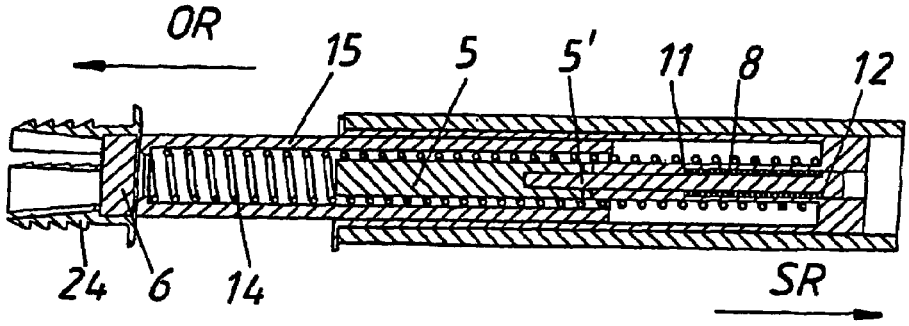

When the second force storage means (elastic element) 8 is entirely loaded up, the first magnetic part 5, 5' of the magnetic retaining device 1 pulls away from the iron core and is moved into the housing 7 again in opposite relationship to the opening direction OR by the force storage means 8 as it is relieved of load while the first force storage means (elastic element) 14 which is being relieved of load and which is acting in the opposite direction further moves the ejection element 15 and therewith the movable furniture element 2 in the opening direction OR (FIG. 2*e*). In other words, in contrast to the state of the art, separation of the two magnetic parts 5, 6 of the magnetic retaining device 1 does not occur abruptly but such separation is damped by the second force storage means 8 which is loaded up in the opening process of the movable furniture element 2. That damping action contributes substantially to noise reduction.

Figure 2F:
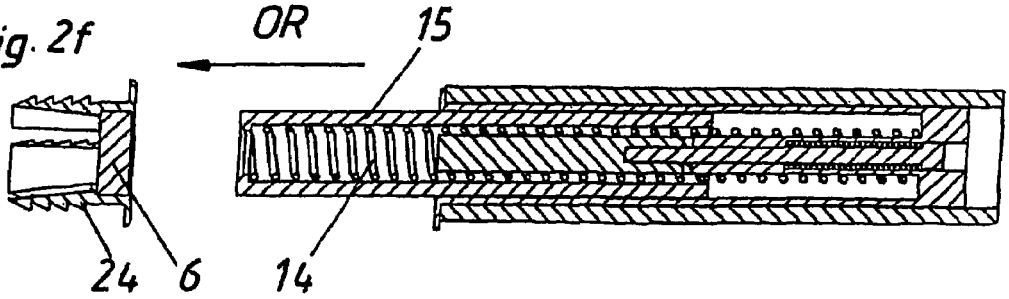

In FIG. 2*f* the ejection element 15 has reached its one end position by virtue of the entirely unloaded first force storage means 14 and the movable furniture element 2 can be easily further opened by the user as separation between the two parts 5, 6 of the magnetic retaining device 1 has in fact already previously occurred.

Figure 3A:
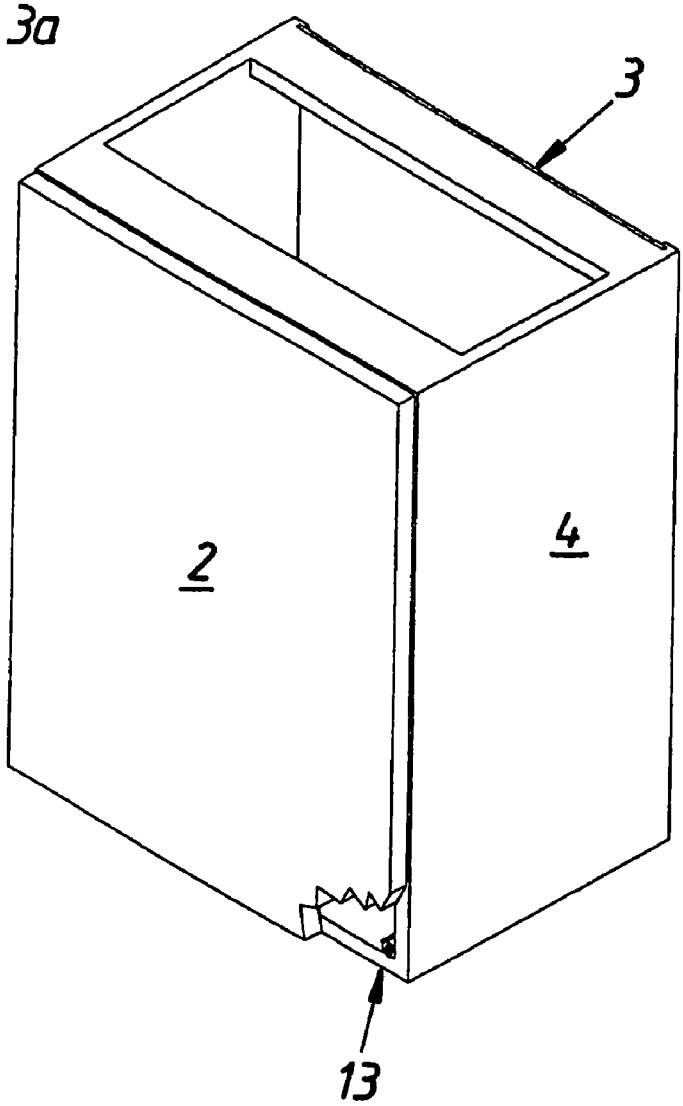
FIGS. 3*a*-3*c* show different views of an article of furniture with a closing and opening device according to the invention.
Figure 3B:
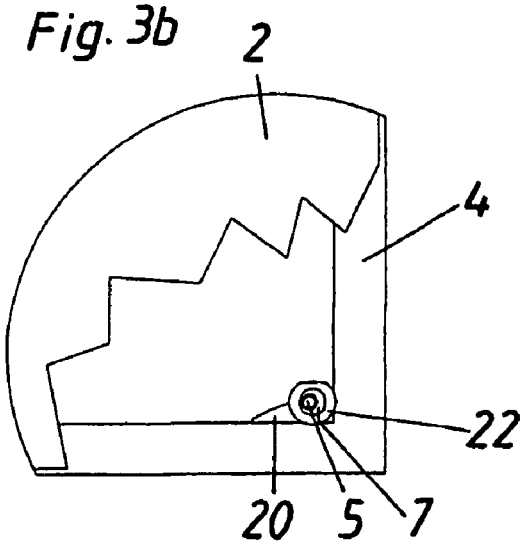
Figure 3C:
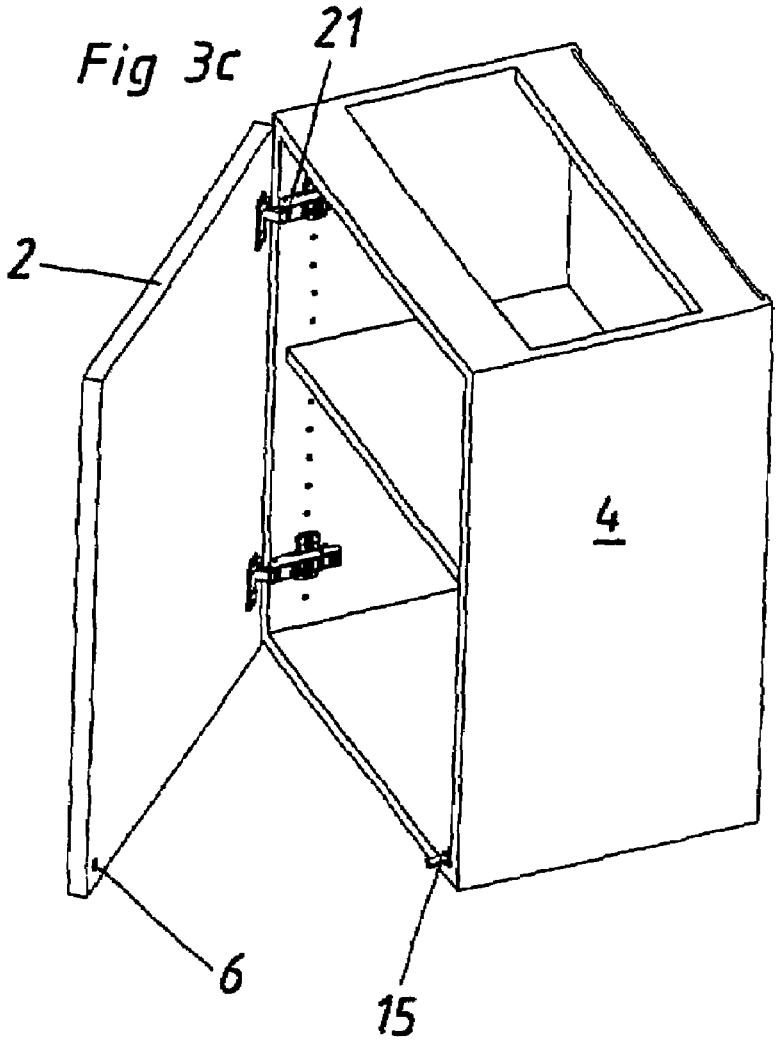

FIGS. 3*a* through 3*c* show an example of use of a closing device 13 according to the invention in relation to an item of furniture 3 in which a movable furniture element 2 is hinged to the furniture body 4 by way of hinges 21. It can be seen from, in particular, FIG. 3*b* that the housing 7 is arranged on the furniture body 4 by way of the axial flange 20, wherein the annular flange 22 arranged around the opening 9 forms an abutment with respect to depth for mounting of the mounting element 16 to the furniture body 4.

Figure 4:
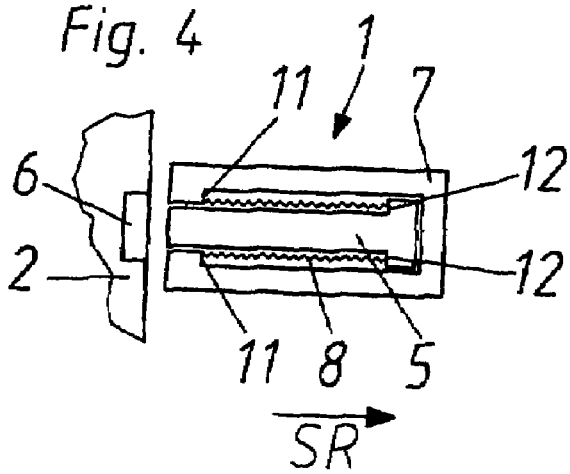
FIG. 4 shows a diagrammatic view illustrating the principle of a magnetic retaining device according to the invention.

The magnetic retaining device 1 shown in FIG. 4 has two parts 5, 6, wherein the first part 5 associated with the furniture body (not shown) is mounted in a housing 7 in such a way that it can extend through an opening on the face thereof while the other part 6 of the magnetic retaining device is arranged in or at the movable furniture element 2.

The first part 5, arranged in the housing 7, of the magnetic retaining device 1 is in that case acted upon by a second force storage means 8 in the form of a spring in the closing direction SR of the movable furniture element 2, wherein the force storage means 8 acts between an abutment 11 of the housing 7, which is provided in the region of the opening 9 on the face inwardly thereof, and a flange-like enlargement 12 provided on the first part 5.

The fact that the operative force of the force storage means 8 is less than the magnetic attraction force between the two parts 5, 6 of the magnetic retaining device 1 means that the first part 5, when the movable furniture element 2 is closed, can extend through the opening 9 on the face of the housing 7 and come into contact with the second part 6, arranged on the movable furniture element 2, of the magnetic retaining device 1. More specifically, the first part 5 is moved against the operative force of the force storage means 8. When contact is made between the two parts 5, 6 of the magnetic retaining device 1, the first part 5 of the magnetic retaining device 1 is moved into the housing 7 again by the force storage means 8 which is then being relieved and in so doing entrains the movable furniture element 2 by virtue of the magnetic attraction force between the two parts 5, 6 of the magnetic retaining device 1. In that respect, which of the two parts 5, 6 of the magnetic retaining device 1 is magnetic and which of the two parts 5, 6 of the magnetic retaining device 1 is magnetizable plays no part. It will be appreciated that it would also be conceivable for both parts 5, 6 of the magnetic retaining device 1 to be of a magnetically attractive nature.

FIG. 5 and FIGS. 9*a* through 9*c* show the individual parts of a further embodiment of a closing and opening device 13 as an exploded view. The closing and opening device 13 includes a second part 6 of the magnetic retaining device 1 which is associated with the movable furniture element 2. That second part 6 of the magnetic retaining device 1 cooperates with the first part 5 of the magnetic retaining device 1 arranged in a cylindrical housing 7. In addition a multi-part ejection element is arranged in that cylindrical housing 7, wherein a second force storage means (elastic element) 8 as well as a holding element 29 for the second force storage means 8 are arranged in a first sleeve-shaped portion 15' of the ejection element 15, besides the first part 5 of the magnetic retaining device 1.

The first portion 15' of the ejection element is connected to the second portion 15" of the ejection element by way of an annular connecting element 28, more specifically in such a way that the second part 15" of the ejection element is mounted rotatably with its front flange 30 in a groove 31 of the holding element 29.

The first portion 15' of the ejection element is acted upon by a first force storage means (elastic element) 14, wherein the second part 15' of the ejection element is arranged within the force storage means 14 which is in the form of a coil spring so that the first force storage means (elastic element) 14 acts directly on the O-shaped connecting element 28.

Figure 9A:
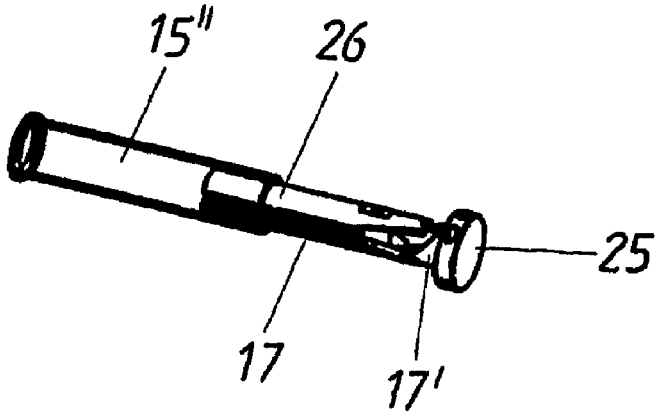
FIGS. 9*a*-9*c* show different views of the embodiment of FIG. 5.
Figure 9B:
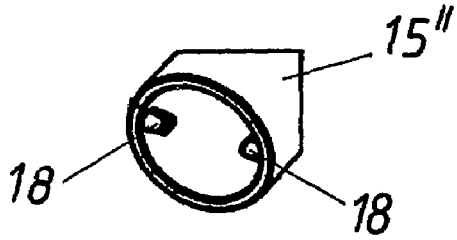
Figure 9C:
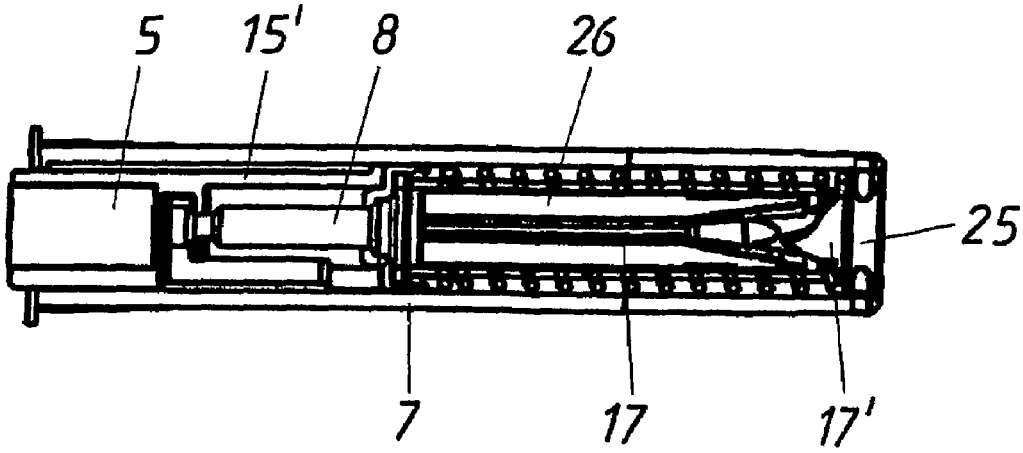

In this embodiment, two control elements 18 in the form of projections (FIG. 9*b*) are arranged at the internal peripheral surface of the second portion 15" of the ejection element, the projections engaging into control cams 17 on a control portion 26. The rotary movement of the second portion 15" of the ejection element is ensured by control portions 17' provided on the closure element 25 (FIGS. 9*a* and 9*c*).

The control element 26 is non-rotatably connected by way of a pin 27 to the closure element 25 for the housing 7, the closure element 25 also being connected non-rotatably with pins 27 to the housing 7.

The illustrated closing and opening device 13 thus represents a touch-latch mechanism which includes a magnetic retaining device and which is based on the per se known ballpoint pen principle.

Figure 5:
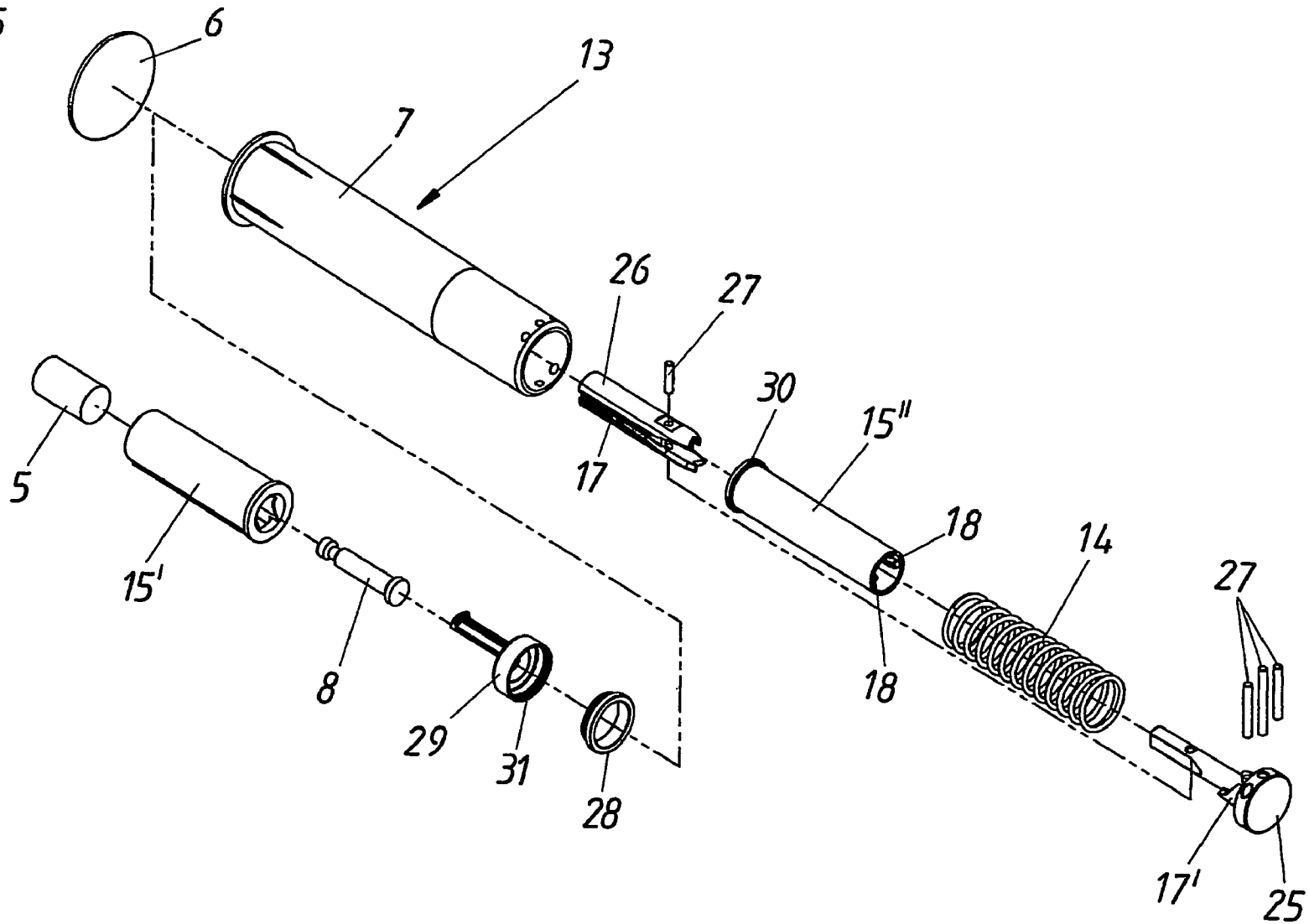
FIG. 5 shows an exploded view of a further embodiment of the invention.

FIGS. 6*a*-6*e* show different positions of the embodiment of FIG. 5. In this case, the movable furniture element 2 is only diagrammatically indicated and the second part 6 of the magnetic retaining device 1 has not been shown.

Figure 6A:
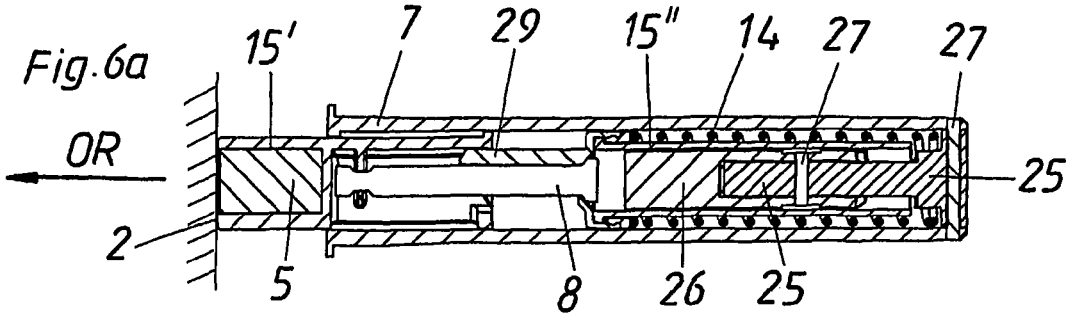
FIGS. 6*a*-6*e* show different positions of the embodiment of FIG. 5 during an opening/closing process.
Figure 6B:
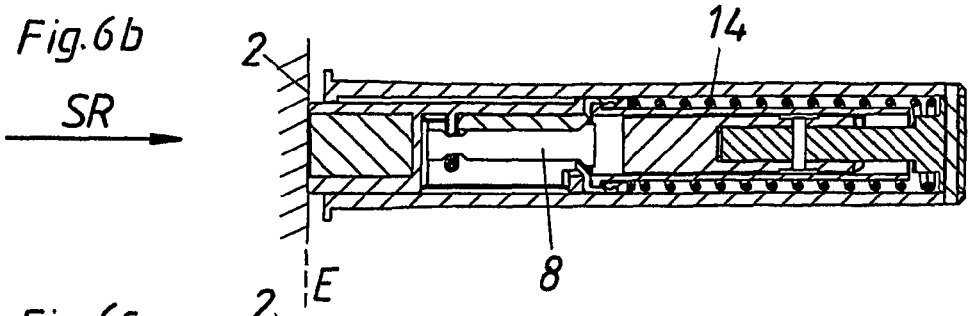

In FIG. 6*a*, the movable furniture element 2 is just performing a rebound movement in the opening direction OR of the movable furniture element 2. At that moment, the ejection device is locked. In other words, the second portion 15" of the ejection element is held non-rotatably in the housing 7 while the first portion 15' of the ejection element, together with the first part 5 of the magnetic retaining device 1, is moved out of the housing 7 in the opening direction OR of the movable furniture element 2 by virtue of the magnetic attraction force between the second part 6 arranged on the movable furniture element 2 to the first part 5 of the magnetic retaining device 1, against the action of the second force storage means (elastic element) 8 which in the illustrated embodiment is formed by a tension spring. In other words, the second force storage means 8 acts as a rebound brake in the position shown in FIG. 6*a*.

Figure 6C:
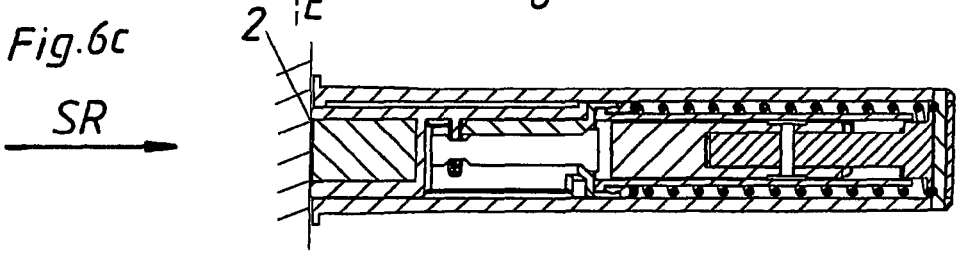

After the movable furniture element 2 has come to a stop, the first portion 15' of the ejection element together with the first part 5 of the magnetic retaining device 1 is moved towards the furniture body by way of the second force storage means 8 which is relieved of load (applies urging force) in the closing direction SR of the movable furniture element 2, until that movable portion has reached its closed end position E. The front gap remaining between the movable furniture element 2 and the furniture body is necessary to be able to move the movable furniture element 2 in the closing direction SR into a release position which is behind the closed end position E and in which unlocking of the ejection device occurs (FIG. 6*c*). The second force storage means 8 is relieved of load in that release position of the movable furniture element 2.

Figure 6D:
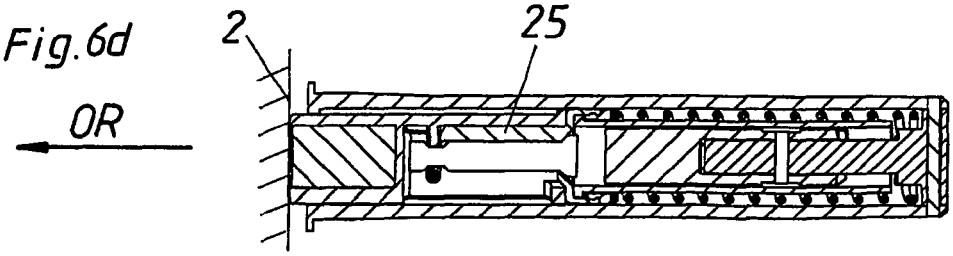

In FIG. 6*d*, the user has already terminated the application of pressure to the movable furniture element 2 so that the movable furniture element 2 is moved in the opening direction OR into an open position by virtue of the unlocked second portion 15" of the ejection element by means of the first portion 15' of the ejection element, which is acted upon by the first force storage means (elastic element) 14 as it is relieved of load.

Figure 6E:
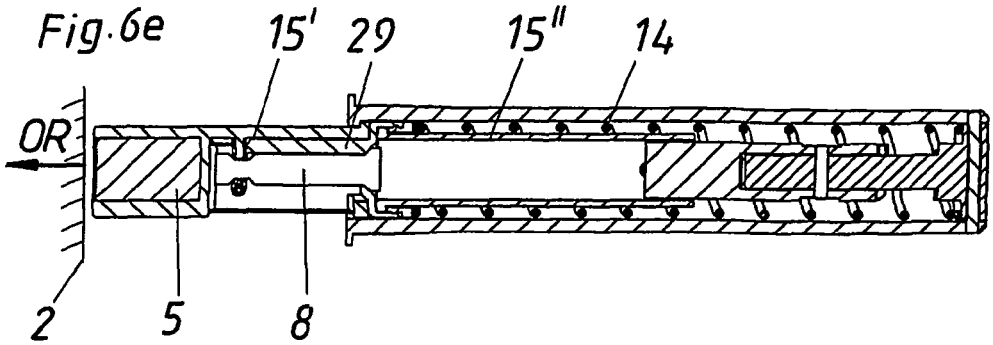

When, as shown in FIG. 6*e*, the first portion 15' of the ejection element 20' comes into butting relationship against the inside of the housing 7, the second part 6 of the magnetic retaining device 1, which is arranged at the movable furniture element 2, comes away from the first part 5 of the magnetic retaining device 1 and the movable furniture element 2 can now be moved by the user into its opened end position. When the movable furniture element 2 in the subsequent course of movement is closed, the first force storage means 14 is loaded and the opening and closing device 13 locked.

Figure 7:
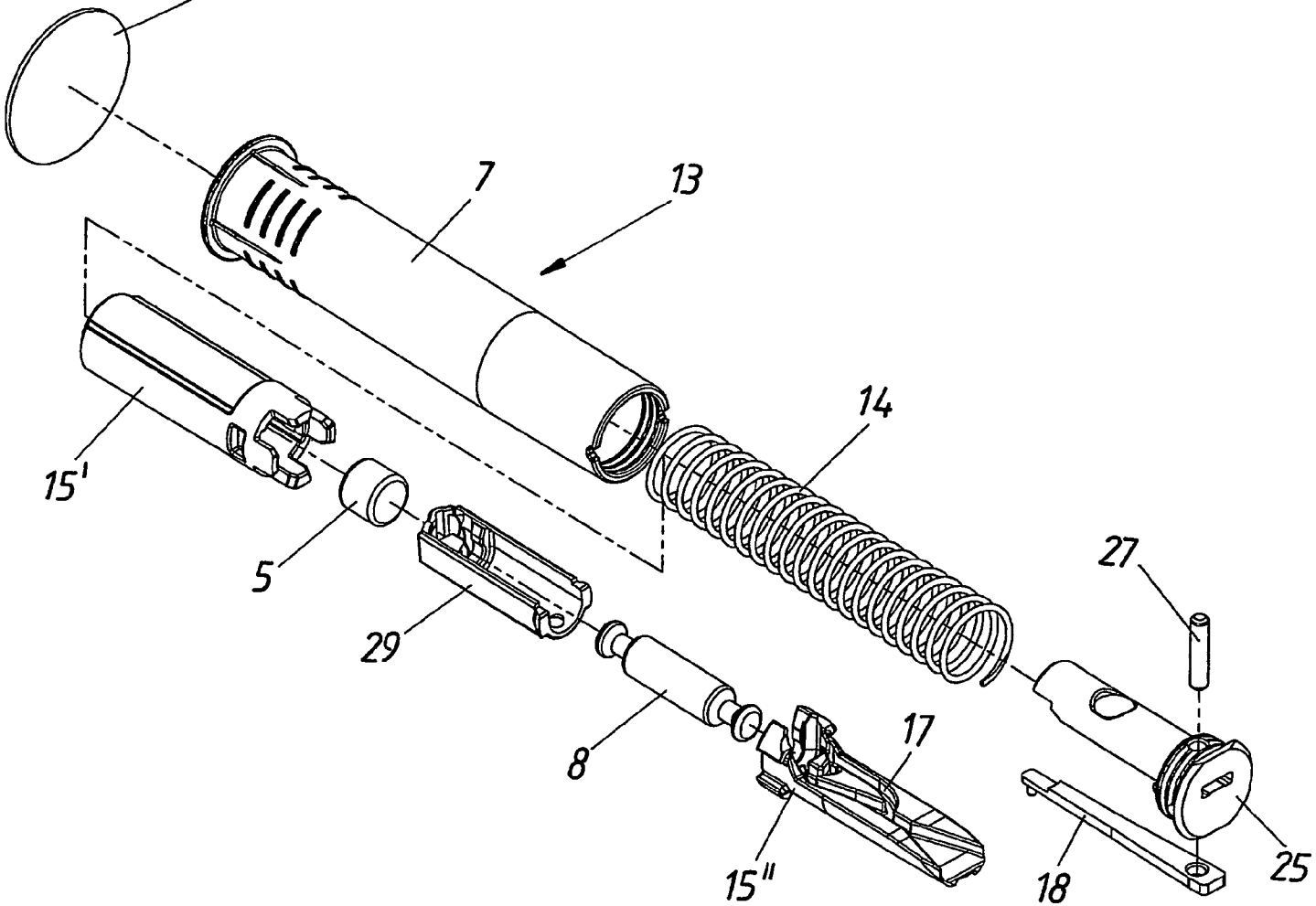
FIG. 7 shows a third embodiment of the invention.
Figure 8A:
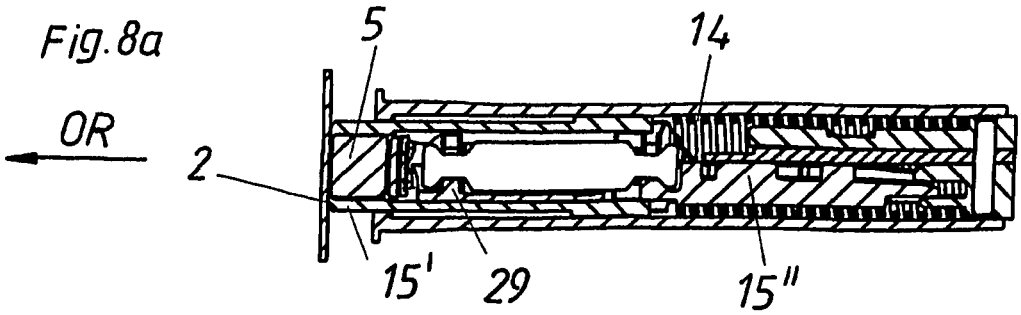
FIGS. 8*a*-8*e* show different positions of the embodiment of FIG. 7 during an opening/closing process.
Figure 8B:
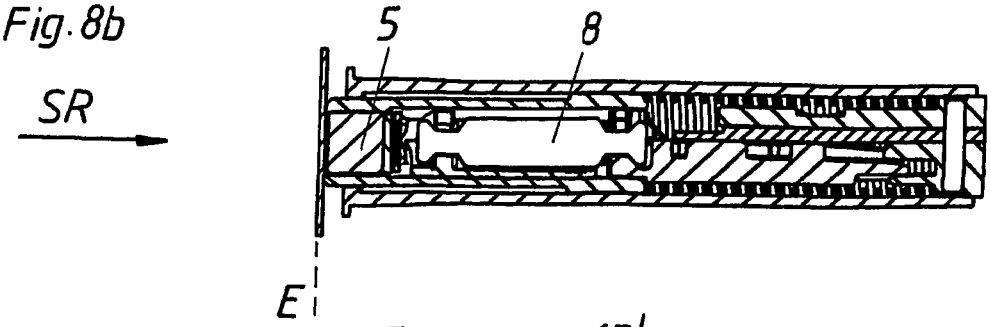
Figure 8C:
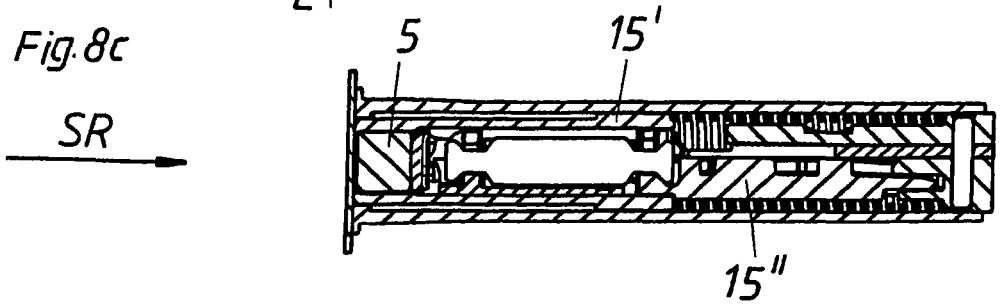
Figure 8D:
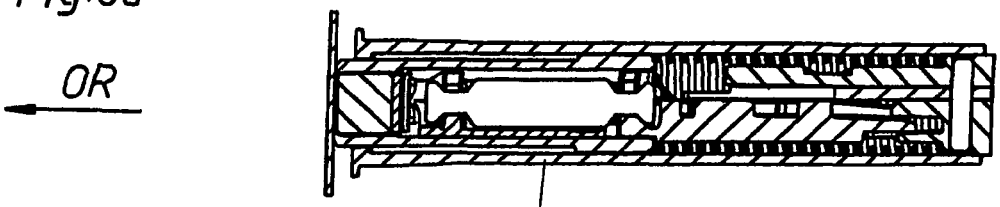
Figure 8E:
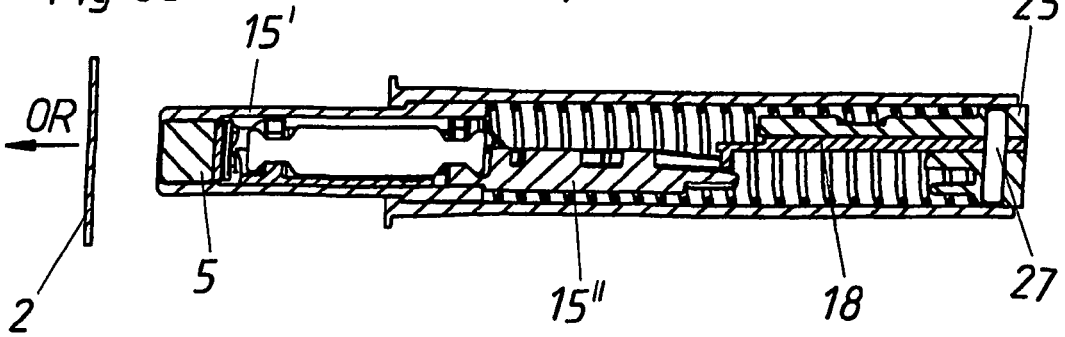

FIG. 7 shows an exploded view of a further embodiment of a closing and opening device 13 according to the invention. Referring to FIG. 5, the same parts are identified in the same fashion, and for that reason will not be described once again here. In contrast to the embodiment of FIG. 5 in this embodiment, the second portion 15" of the ejection element has the control cam 17 into which engages a control element 18 fixedly connected to the closure element 25 for the housing 7. The first portion 15' of the ejection element again has a sleeve-shaped configuration, accommodating the holding element 29, in which the first part 5 of the magnetic retaining device 1 is mounted. The second force storage means (elastic element) 8 acts between that holding element 29 arranged in the first portion 15' of the ejection element and the second portion 15" of the ejection element.

The positions of the opening and closing device 13 shown in FIG. 8*a*-8*e* correspond to those shown in FIG. 6*a*-6*e*. The opening and closing procedure in each case will therefore not be described again here. The embodiment of FIG. 5 differs from that of FIG. 7 primarily by the nature of the lockable ejection device. While the embodiment of the FIG. 5 provides that the lockable ejection device is formed by a touch-latch mechanism functioning on the basis of the ballpoint pen principle, the embodiment of FIG. 7 has a control lever 18 engaging into a heart-shaped control cam 17.

This means that the two portions 15', 15" of the ejection element in the FIG. 5 embodiment are mounted in the housing 7 jointly movably in the longitudinal direction and the second portion 15" of the ejection element is mounted rotatably about its longitudinal axis with respect to the first portion 15' of the ejection element.

The embodiment of FIG. 7 does not require rotatability of the second portion 15" of the ejection element. Thus, the two portions 15', 15" of the ejection element can be mounted in the housing 7 only movably jointly in the longitudinal direction thereof.

Even if the invention has been described in concrete terms by means of the illustrated embodiments by way of example, it should be pointed out that the subject-matter of the application is not limited to those embodiments. Rather measures and modifications which serve to implement the concept of the invention of a magnetic retaining device which is acted upon by a force storage means (elastic element) acting in the closing direction of a movable furniture element are certainly conceivable and desired. Thus, for example, the magnetic portion of the magnetic retaining device could be arranged on the movable furniture element. It would equally be conceivable for the coaxial arrangement of the ejection element and the first part of the magnetic retaining device to be reversed so that the ejection element would be arranged within the sleeve-shaped first part of a magnetic retaining device, in such a way that it can pass therethrough. Furthermore it would be possible in the embodiment of FIG. 5 for the arrangement of the control cam and the control elements to be reversed, that is to say it would be possible for the control elements to be arranged on the control member and the control cam at the internal peripheral surface of the second portion of the ejection element.

The invention claimed is:

1. A closing and opening device to be used on a furniture element having a furniture body and a movable furniture part movable towards and away from the furniture body, said closing and opening device comprising:

a lockable ejection device to be mounted on the furniture body for moving the movable furniture part out of a closed position into an open position, said lockable ejection device including an ejection element and a first force storage means for applying an urging force to said ejection element in an opening direction of the movable furniture part;

a magnetic retaining device including a first part and a second part which exert a magnetic attraction force on each other at least in a closed position of the movable furniture part, said first part being mounted to said ejection element of said ejection device, and said second part to be mounted on the movable furniture part; and a second force storage means for applying an urging force to said first part of said retaining device in a closing direction of the movable furniture part, said second force storage means being located between said first part of said retaining device and said first force storage means, wherein said first force storage means and said second force storage means are arranged so as to act upon said ejection element.

2. The closing and opening device of claim 1, further comprising a housing having an opening, said first part of said retaining device being mounted in said housing so as to be movable through said opening.

3. The closing and opening device of claim 2, wherein said housing is cylindrical.

4. The closing and opening device of claim 2, wherein said second force storage means comprises a pressure storage member arranged between an abutment at said opening of said housing and a flange-like enlargement at said first part of said retaining device.

5. The closing and opening device of claim 1, further comprising a housing having an exit opening, said ejection element and said first part of said retaining device being arranged so as to be movable relative to each other in said housing.

6. The closing and opening device of claim 5, wherein said second ejection element and said first part of said retaining device are arranged coaxially within said housing.

7. The closing and opening device of claim 5, wherein said ejection element has a sleeve-shaped configuration, and said first part of said retaining device is arranged in an interior of said sleeve-shaped ejection element.

8. The closing and opening device of claim 5, further comprising a mounting element having an open face and in which said housing is arranged, said ejection element being sleeve-shaped, and said housing being cylindrically-shaped and receiving said sleeve-shaped ejection element and said first part of said retaining device, said first part being mounted coaxially with said sleeve-shaped ejection element in an interior of said sleeve-shaped ejection element, said ejection element having a control cam at an external peripheral surface thereof into which a control element at an internal peripheral surface of said cylindrical housing is engaged.

9. The closing and opening device of claim 8, wherein said mounting element is tubular.

10. The closing and opening device of claim 1, wherein said ejection element has a multi-part structure including a first portion and a second portion, said second force storage means is arranged between said first portion and said second portion of said ejection element.

11. The closing and opening device of claim 10, further comprising a housing having at least one exit opening, said first portion and said second portion of said ejection element being arranged in said housing.

12. The closing and opening device of claim 11, wherein said first portion and said second portion of said ejection element are configured to be movable relative to each other in said housing.

13. The closing and opening device of claim 10, further comprising a housing, said first portion and said second portion of said ejection element being arranged in said housing so as to be movable in a longitudinal direction of said housing and/or rotatably about a longitudinal axis thereof.

14. The closing and opening device of claim 13, wherein said first part of said retaining device is arranged in an interior of said first portion of said ejection element.

15. The closing and opening device of claim 14, wherein said first portion of said ejection element is sleeve-shaped.

16. The closing and opening device of claim 14, wherein said first portion of said ejection element and said first part of said retaining device are arranged coaxially in said housing.

17. The closing and opening device of claim 13, wherein at least one of said first part and said second part of said retaining device is magnetic.

18. The closing and opening device of claim 10, further comprising a control cam for receiving a control element, said control cam being arranged at said second portion of said ejection element.

19. The closing and opening device of claim 18, further comprising a housing, said control element being connected in a stationary manner to said housing.

20. The closing and opening device of claim 10, further comprising a control cam and a control element for engagement into said control cam, said control element being arranged at said second portion of said ejection element.

21. The closing and opening device of claim 20, further comprising a housing, said control cam being connected in a stationary manner to said housing.

22. The closing and opening device of claim 10, wherein said first force storage means is configured to apply an urging force to said first portion of said ejection element.

23. An item of furniture comprising:

a furniture body;

a movable furniture part movable with respect to said furniture body; and said closing and opening device of claim 1.

* * * * *